US010477992B1

(12) United States Patent
Merschman et al.

(10) Patent No.: US 10,477,992 B1
(45) Date of Patent: Nov. 19, 2019

(54) DISPLAY APPARATUS

(71) Applicant: Homemakers Plaza, Inc., Urbandale, IA (US)

(72) Inventors: Roger Paul Merschman, Altoona, IA (US); Francis Edward Masterson, Runnells, IA (US)

(73) Assignee: Homemakers Plaza, Inc., Urbandale, IA (US)

( * ) Notice: Subject to any disclaimer, the term of this patent is extended or adjusted under 35 U.S.C. 154(b) by 0 days.

(21) Appl. No.: 16/055,977

(22) Filed: Aug. 6, 2018

(51) Int. Cl.

| | |
|---|---|
| ***A47F 7/16*** | (2006.01) |
| ***A47F 5/01*** | (2006.01) |
| ***A47F 5/00*** | (2006.01) |
| ***A47F 5/13*** | (2006.01) |
| ***A47F 7/17*** | (2006.01) |
| ***A47B 61/00*** | (2006.01) |

(52) U.S. Cl.
CPC ..... *A47F 7/16* (2013.01); *A47B 61/003* (2013.01); *A47F 5/0087* (2013.01); *A47F 5/01* (2013.01); *A47F 5/135* (2013.01); *A47F 7/163* (2013.01); *A47F 7/175* (2013.01)

(58) Field of Classification Search
CPC .. A47F 7/16; A47F 5/0087; A47F 5/01; A47F 7/143; A47F 7/163; A47F 7/17; A47F 7/175; A47F 7/24; A47F 7/26; A47F 5/135; A47F 7/005; B42F 15/06; B42F 15/066; A47B 43/00; A47B 61/003; A47B 63/02; A47G 25/0664; A47G 25/0685
USPC ..... 211/44, 45, 99, 100, 171, 204, 206, 193
See application file for complete search history.

(56) References Cited

U.S. PATENT DOCUMENTS

| | | | | | |
|---|---|---|---|---|---|
| 336,935 | A * | 3/1886 | Miller | A47F 7/163 | 211/45 |
| 392,811 | A * | 11/1888 | Lane | A47F 7/163 | 211/45 |
| 528,498 | A * | 10/1894 | Anderson | D06F 57/12 | 211/101 |
| 805,603 | A * | 11/1905 | Way et al. | A47F 7/175 | 135/153 |
| 814,980 | A * | 3/1906 | McCloskey et al. | A47F 7/30 | 211/208 |
| 916,496 | A * | 3/1909 | Shindlebower | A47F 7/163 | 211/47 |
| 999,189 | A * | 7/1911 | Altvater | A47F 7/163 | 211/181.1 |
| 1,047,053 | A * | 12/1912 | Holland | A47F 7/24 | 211/206 |
| 1,051,452 | A * | 1/1913 | Rock | A47F 5/01 | 211/132.1 |
| 1,061,001 | A * | 5/1913 | Cantwell et al. | A47F 7/163 | 211/47 |
| 1,138,488 | A * | 5/1915 | Kime | A47F 7/163 | 211/125 |
| 1,652,411 | A * | 12/1927 | Randleman | A47F 7/148 | 211/45 |
| 1,688,255 | A * | 10/1928 | Wasch | A47F 7/0042 | 211/168 |

(Continued)

*Primary Examiner* — Jennifer E. Novosad
(74) *Attorney, Agent, or Firm* — Zarley Law Firm, PLC

(57) ABSTRACT

A display apparatus having a support frame having a pair of end members and upper and lower cross bars connected to and extending between the end members. A plurality of support arms having a vertical and horizontal section are pivotally connected to the support frame. The pivotal movement of the support arms is limited by a plurality of stops.

11 Claims, 4 Drawing Sheets

(56) References Cited

U.S. PATENT DOCUMENTS 1,742,164 A * 12/1929 Berke ..... A47F 5/02 211/107
1,745,713 A * 2/1930 Reed ..... A47F 7/166 211/48
2,000,336 A * 5/1935 Kerr ..... A47F 7/166 211/46
2,252,402 A * 8/1941 Kern ..... A47B 63/02 211/45
D134,111 S * 10/1942 Bersin et al. ..... 211/45
2,305,754 A * 12/1942 Woodruff, Jr. ..... A47F 5/02 211/45
2,830,708 A * 4/1958 Miller ..... A47F 7/166 211/120
2,842,268 A * 7/1958 Gumplo ..... B42F 15/06 211/175
3,094,216 A * 6/1963 Gordon ..... A47F 7/163 211/45
3,187,900 A * 6/1965 Schneider ..... A47F 7/163 211/168
3,207,318 A * 9/1965 Gilbert ..... B42F 15/0005 206/309
3,315,813 A * 4/1967 Schneider ..... A47F 7/16 211/1.51
3,330,418 A * 7/1967 Schneider ..... A47F 7/16 211/169
3,472,387 A * 10/1969 Olsen ..... B42F 15/0094 211/45
3,603,461 A * 9/1971 Best ..... A47F 7/16 211/47
3,935,949 A * 2/1976 Cohen ..... A47F 5/01 211/168
4,103,778 A * 8/1978 Bradshaw ..... A47F 5/01 211/102
D253,450 S * 11/1979 Butcher ..... D6/682.6
4,197,950 A * 4/1980 Ovitz, III ..... A47F 7/163 211/134
D260,466 S * 9/1981 Butcher ..... D6/682.6
4,305,510 A * 12/1981 Eppy ..... A47B 81/067 211/169
4,315,572 A * 2/1982 Clare ..... B42D 17/00 211/105.1
4,503,979 A * 3/1985 Morand ..... B42F 15/06 211/45
4,620,635 A * 11/1986 Morand ..... B42F 15/06 211/116
4,697,710 A * 10/1987 Gradecki ..... A47F 7/163 211/45
4,936,471 A * 6/1990 Walter ..... A47F 5/106 211/182
4,948,202 A * 8/1990 Helseth ..... A47F 3/00 211/45
D321,105 S * 10/1991 Tenser ..... D6/572
5,292,011 A * 3/1994 Kostigian ..... A47F 7/16 211/103
5,452,809 A * 9/1995 Capel ..... A47F 7/163 211/168
5,649,631 A * 7/1997 Loflin ..... A47F 7/175 211/168
D383,327 S * 9/1997 Loflin ..... D6/566
6,170,674 B1 * 1/2001 Caterinacci ..... A47F 7/0042 211/41.1
6,394,291 B2 * 5/2002 Maier-Hunke ..... G09F 15/0087 211/169
6,547,087 B2 * 4/2003 Accatino ..... A47F 5/132 211/169
6,588,607 B2 * 7/2003 Smith ..... A47F 5/05 211/96
6,691,878 B1 * 2/2004 Ouitz ..... A47B 97/00 211/103
D494,777 S * 8/2004 Walk ..... D6/678.4
6,981,596 B2 * 1/2006 Kin ..... A47F 5/137 211/168
D521,769 S * 5/2006 Israel ..... D6/681.1
D526,105 S * 8/2006 Van Es ..... D34/21
D549,003 S * 8/2007 Biser ..... D6/679
8,757,398 B2 * 6/2014 Letinic ..... A47F 7/0042 211/45
10,021,996 B2 * 7/2018 Cantwell ..... A47F 5/0807
2005/0011054 A1 * 1/2005 Kin ..... A47F 5/137 24/530
2005/0133470 A1 * 6/2005 Kin ..... A47F 7/16 211/45
2006/0131249 A1 * 6/2006 Kostigian ..... A47F 7/166 211/45

* cited by examiner

DISPLAY APPARATUS

BACKGROUND OF THE INVENTION

The present invention is directed to a display apparatus, and more particularly to an apparatus for displaying large and heavy objects such as rugs and the like.

With respect to the display of large rugs, typically they are hung on a wall or stacked on the floor or a platform. To hang a large rug on a wall requires mounting a support structure to the wall which can be expensive, requires many parts, and is fixed to a specific location. Rugs stacked on the floor or a platform are difficult to view as one typically flips through a corner of the stack and is not able to see the full rug. Accordingly, a need exists in the art for an apparatus that addresses these deficiencies.

An objective of the present invention is to provide a display apparatus that easily and inexpensively displays large objects like rugs.

Another objective of the present invention is to provide a display that is not fixed to a location and permits the entire object to be viewed.

These and other objectives will be apparent to one having ordinary skill in the art based upon the following written description, drawings, and claims.

SUMMARY OF THE INVENTION

A display apparatus has a pair of end members with cross bars connected to and extending between the end members. The end members have a horizontal base section and a vertical section. The base section engages the floor or is supported by a transport device. Braces are connected to and extend between the vertical and base sections.

The cross bars include a pair of upper and lower cross bars. Connected to and extending upwardly from the lower cross bars are a plurality of arm support tubes. The arm support tubes extend upwardly between the upper cross bars. Connected to an outer surface of the upper cross bars, adjacent the end members, are a plurality of stops. The stops limit the pivotal movement of the support arms by engaging the horizontal section.

Pivotally connected to the support frame are a plurality of arm supports. In one example, the arm supports have a horizontal section and a vertical section. The vertical section is received within the arm support tubes and pivots or rotates about a vertical axis.

DETAILED DESCRIPTION OF THE PREFERRED EMBODIMENT

Figure 1:
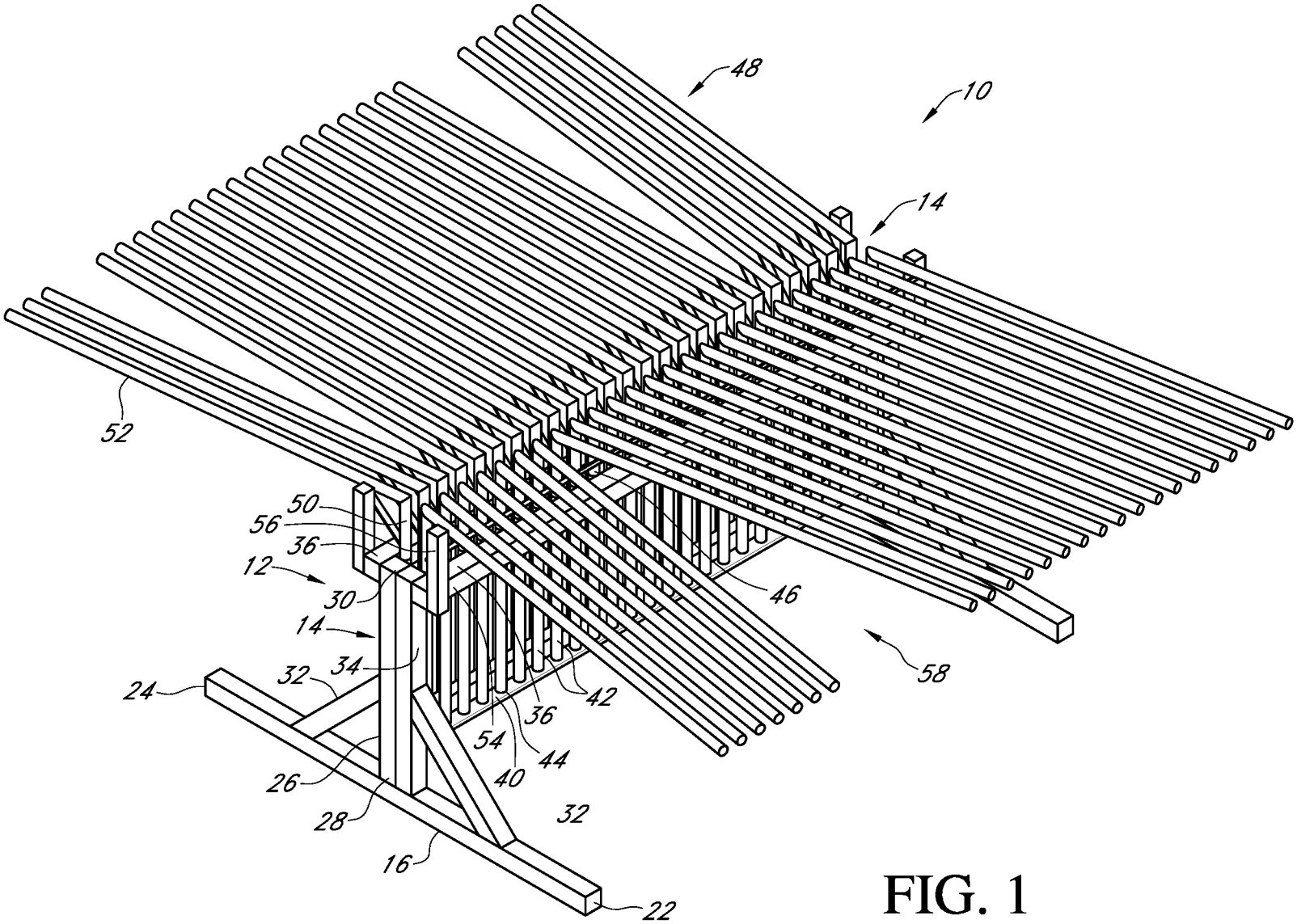
FIG. 1 is a perspective view of a display apparatus.
Figure 2:
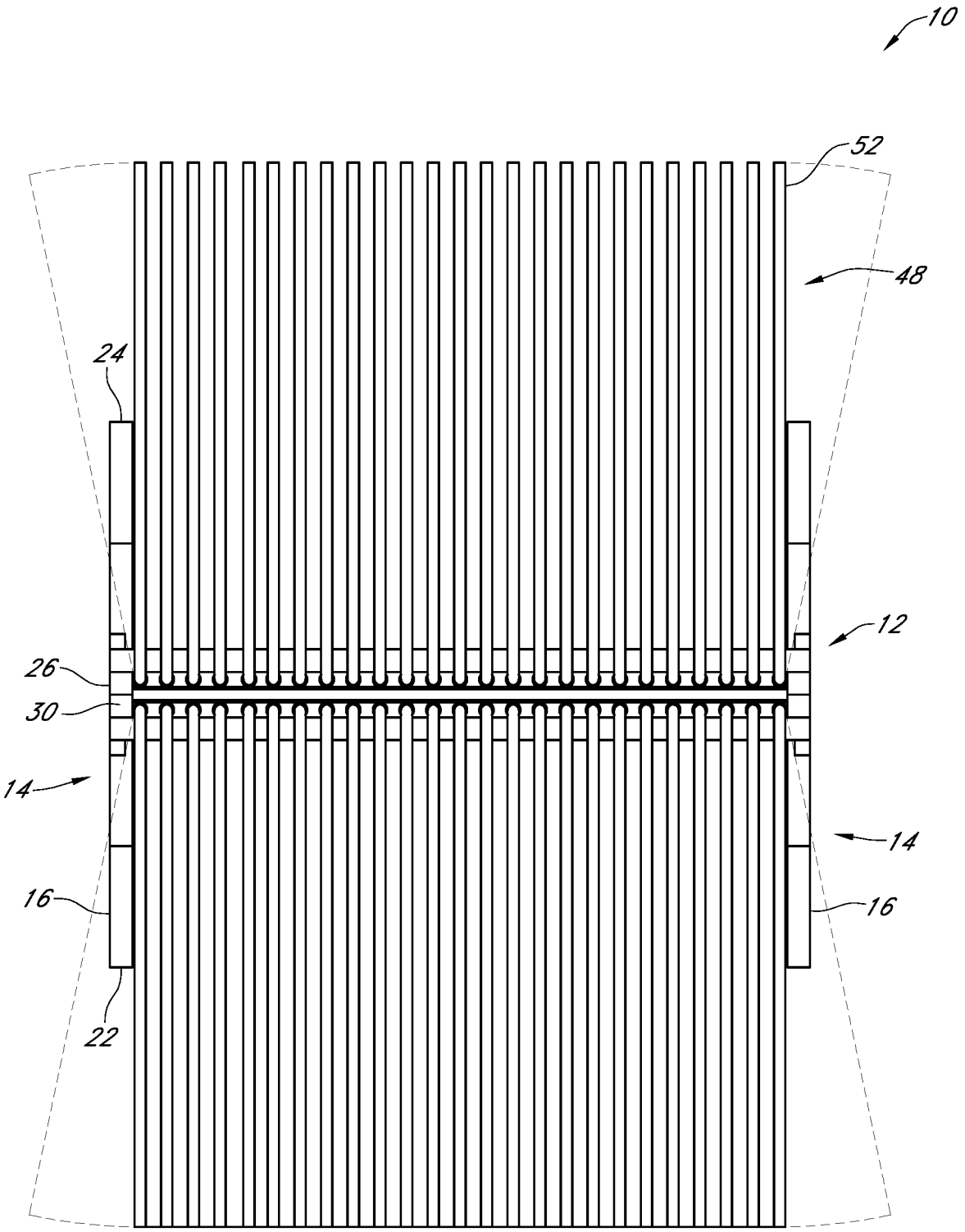
FIG. 2 is a top plan view of a display apparatus.
Figure 3:
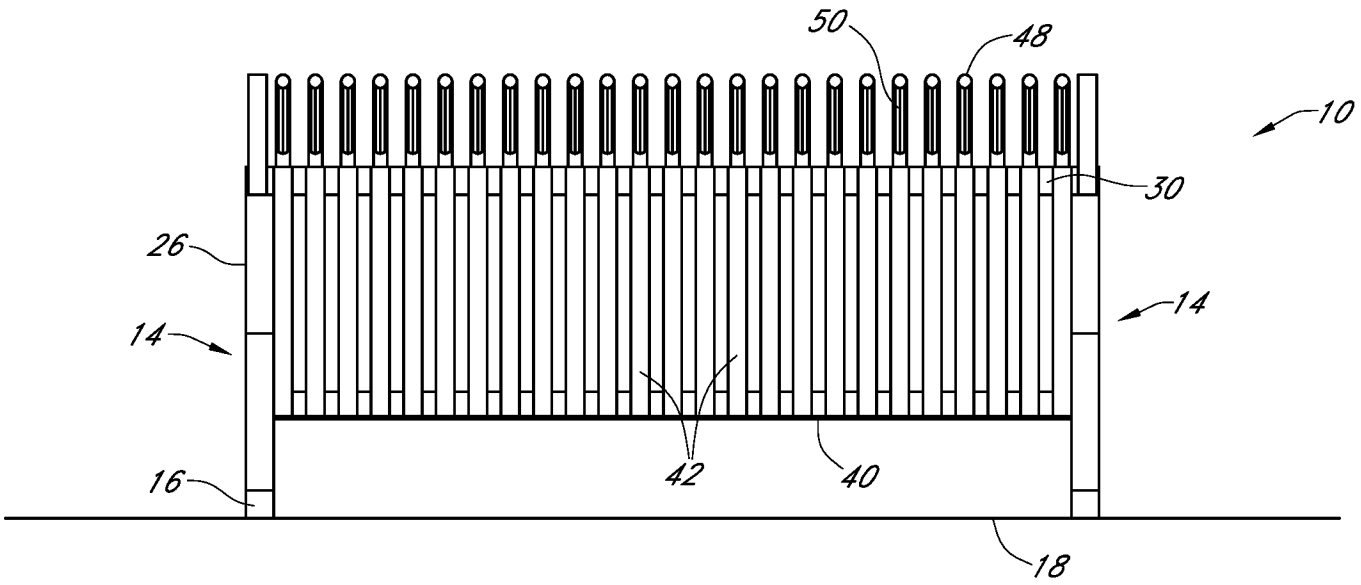
FIG. 3 is a front view of a display apparatus.
Figure 4:
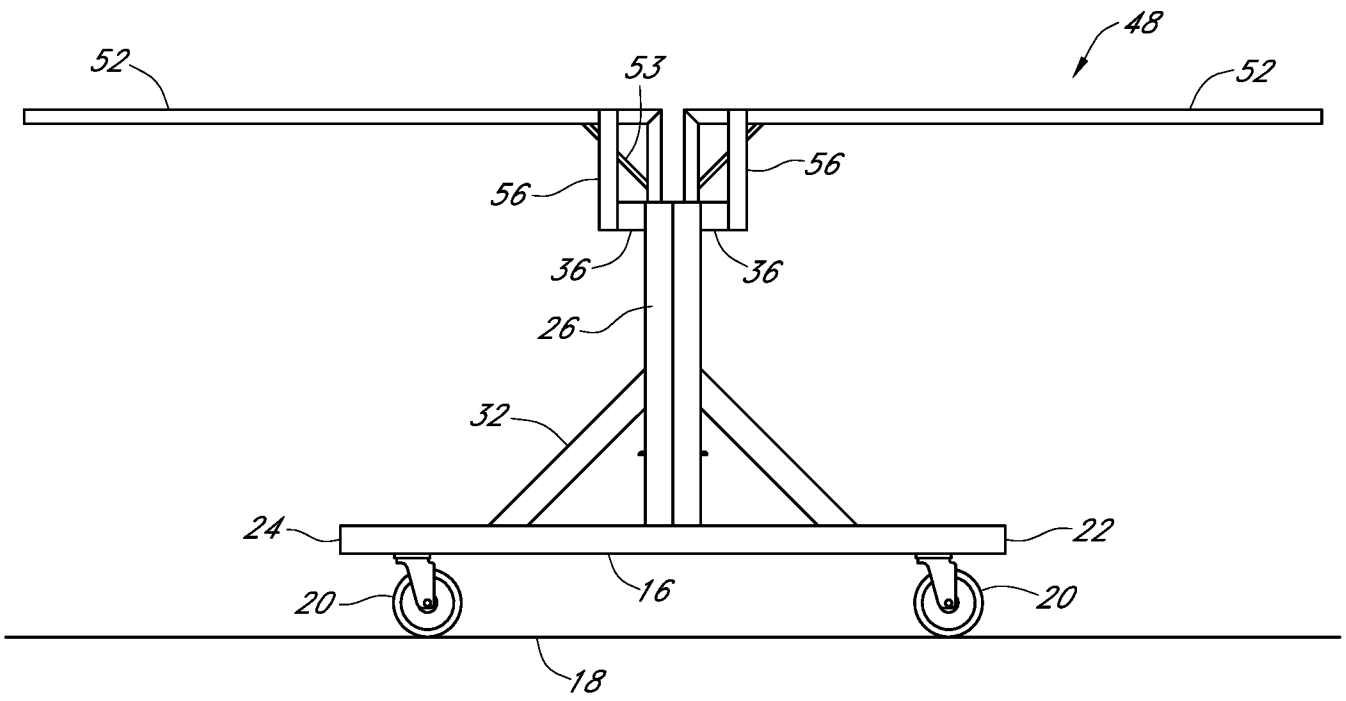
FIG. 4 is a side view of a display apparatus.

Referring to the figures, a display apparatus 10 has a support frame 12 that includes a pair of end members 14. The end members 14 have an elongated horizontal base section 16 that engages a floor surface 18. Alternatively, the base section 16 is supported by a transport device 20 such as caster wheels or the like. The base section 16 has a first end 22 and a second end 24.

Welded to the top center of the base section 16 is a vertical section 26 that extends upwardly from and perpendicular to the base section 16. The vertical section 26 has a first end 28 welded to the base section 16 and an opposite second end 30. The vertical section 26 is of any shape, structure or size and preferably is formed by a pair of steel tubes. To provide stability, a pair of braces 32 are welded to and extend between the base section 16 and the vertical section 26.

Welded to a side surface 34 of the vertical section 26 adjacent the second end 30 and extending between the end members 14 are a pair of parallel spaced upper cross bars 36. Welded to an inner surface 38 of the vertical section 26, below a midpoint of the vertical section 26, and extending between the end members 14 are a pair of lower cross bars 40.

Welded to and extending upwardly and perpendicularly to the lower cross bars 40 are a plurality of hollow arm support tubes 42. The arm support tubes 42 have a first end 44 welded to the lower cross bars 40 and a second end 46 that extends between and is welded to the upper cross bars 36.

Pivotally mounted to the arm support tubes 42 about a vertical axis are a plurality of support arms 48. The support arms 48 are of any size, shape and structure and are pivotally mounted in any manner such as with a bracket and a pivot pin or the like. In a preferred example, as shown, the support arms 48 have a vertical section 50 and a horizontal section 52. The vertical section 50 is adapted and configured to be pivotally received within the hollow arm support tubes 42. The horizontal section 52 extends outwardly generally parallel to the base section 16 of the end members 14. Preferably, the horizontal sections 52 are longer than and extend beyond the ends 22 and 24 of the base section 16 to reduce the chance of one tripping over the base section 16. Connected to and extending between the vertical section 50 and the horizontal section 52 are arm support braces 53.

Welded to an outer side surface 54 of the upper cross bars 36 adjacent the end members 14 and extending upwardly from the upper cross bars 36 are a pair of stops 56. The stops 56 are positioned to engage the horizontal section 52 of the support arms 48 and limit the support arms 48 rotational movement.

In operation, the vertical section 50 of the support arms 48 is inserted within the arm support tubes 42. Display objects (not shown) such as a rug or the like are draped over the horizontal section 52 of the support arms 48. Using manual force applied to the horizontal section 52 of the support arms 48, the support arms 48 are partially rotated toward end members 14 to create a viewing space 58. The stops 56 limit the amount of rotation available.

Accordingly, a display apparatus has been disclosed that, at the very least, meets all the stated objectives.

From the above discussion and accompanying figures and claims it will be appreciated that the display apparatus 10 offers many advantages over the prior art. It will be appreciated further by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A display apparatus, comprising:

a support frame having end members and cross bars that extend between the end members;

wherein the cross bars include upper and lower cross bars;

a plurality of arm support tubes connected to the support frame;

wherein the plurality of arm support tubes are connected to one of the lower cross bars at a first end and extend vertically and between the upper cross bars at a second end;

a plurality of support arms each having a vertical section and a horizontal section;

wherein the vertical section of each of the plurality of support arms receives one of the plurality of arm support tubes at one end, and the horizontal section extends from an opposite end of the vertical section and terminates in an end.

2. The apparatus of claim 1 wherein the end members have a base section and a vertical section.

3. The apparatus of claim 2 further comprising braces that extend between the vertical section and the base section of the end members.

4. The apparatus of claim 1 wherein, adjacent the end members, stops are connected to the upper cross bars.

5. The apparatus of claim 4 wherein the stops are connected to an outer side surface of the upper cross bars.

6. The apparatus of claim 5 wherein the stops are positioned adjacent the end member and extend upwardly from the upper cross bars.

7. The apparatus of claim 1 wherein the horizontal section of the plurality of support arms extend beyond ends of a base section of the end members.

8. The apparatus of claim 1 wherein the end members have a base section supported by a transport device.

9. The apparatus of claim 1 wherein the plurality of arm support tubes are welded to the upper cross bars at the second end.

10. A display apparatus, comprising:

a support frame having end members and cross bars that extend between the end members;

a plurality of arm support tubes connected to the support frame, wherein the plurality of arm support tubes are connected to a lower cross bar at a first end and extend vertically and between a pair of upper cross bars at a second end;

a plurality of support arms pivotally connected to the support frame by receipt by one of the plurality of arm support tubes; and the plurality of support arms consisting of a vertical section and a horizontal section, wherein the horizontal section extends from the vertical section and terminates in an end.

11. The apparatus of claim 10 wherein the plurality of arm support tubes are welded to one of the pair of upper cross bars at the second end.

* * * * *